US008857352B2

(12) United States Patent
Cohen

(10) Patent No.: US 8,857,352 B2
(45) Date of Patent: Oct. 14, 2014

(54) LIGHTWEIGHT FOLDING TABLE

(76) Inventor: Warren Cohen, Philadelphia, PA (US)

( * ) Notice: Subject to any disclaimer, the term of this patent is extended or adjusted under 35 U.S.C. 154(b) by 83 days.

(21) Appl. No.: 13/470,297

(22) Filed: May 12, 2012

(65) Prior Publication Data

US 2012/0285351 A1 Nov. 15, 2012

Related U.S. Application Data

(60) Provisional application No. 61/485,780, filed on May 13, 2011.

(51) Int. Cl.
*A47B 3/00* (2006.01)

(52) U.S. Cl.
USPC ..... 108/169; 108/115; 108/174

(58) Field of Classification Search
USPC ..... 108/162, 163, 166, 171, 174, 67, 115, 108/19, 12, 18, 34–36, 125, 129
See application file for complete search history.

(56) References Cited

U.S. PATENT DOCUMENTS

| | | | | | |
|---|---|---|---|---|---|
| 458,930 | A * | 9/1891 | Wood | 190/12 R |
| 513,311 | A * | 1/1894 | Eptein | 108/34 |
| 564,711 | A * | 7/1896 | OBrien | 108/35 |
| 732,585 | A * | 6/1903 | Reinhardt | 108/19 |
| 1,103,869 | A * | 7/1914 | Duchez | 190/12 R |
| 1,781,562 | A * | 11/1930 | Wallis | 108/35 |
| 2,522,642 | A * | 9/1950 | Schmidt | 297/139 |
| 2,549,242 | A * | 4/1951 | Ross | 108/15 |
| 2,588,405 | A * | 3/1952 | Munger | 108/34 |
| 2,760,837 | A * | 8/1956 | Wade | 108/36 |
| 3,074,770 | A | 1/1963 | Sqob | |
| 3,271,075 | A * | 9/1966 | Good | 297/423.41 |
| 4,223,945 | A * | 9/1980 | Nikitits | 297/158.4 |
| 4,583,467 | A * | 4/1986 | Tiffany | 108/19 |

* cited by examiner

*Primary Examiner* — Janet M Wilkens
(74) *Attorney, Agent, or Firm* — LaMorte & Associates, P.C.

(57) ABSTRACT

A folding table assembly having both a tabletop and legs that fold into smaller sizes. The tabletop has a main panel, a first side flap panel, and a second side flap panel. The side flap panels are joined to the main panel with hinge connections. The hinge connections enable the side flap panels to rotate from open positions that are coplanar with the main panel to folded positions that are under the main panel. The folding legs are coupled to the side flap panels. The folding legs can move between extended positions, where the legs support the tabletop, and retracted positions, where the legs are folded flush against the side flap panels. This enables the legs to fold flush against the side flap panels so that the legs are interposed between the main panel and the two side panels.

11 Claims, 3 Drawing Sheets

LIGHTWEIGHT FOLDING TABLE

RELATED APPLICATIONS

This applications claims the priority of provisional patent application No. 61/485,780, entitled Lightweight Folding Table, filed May 13, 2011, the disclosure of which is incorporated by reference.

BACKGROUND OF THE INVENTION

1. Field of the Invention

In general, the present invention relates to the structure of collapsible tables. More particularly, the present invention relates to tables, where both the tabletop and the table legs are collapsible to form a compact folded table.

2. Prior Art Description

Many people like to carry a table to the beach or to a picnic. However, although many folding tables exist, few are light enough and small enough to justify the effort it takes to carry them long distances.

Many folding tables, such as card tables and banquet tables, have legs that fold for convenience of storage. These tables, although foldable, are heavy and are not intended to be carried by a single person across any significant distance. Lighter, smaller tables, such as food tray tables, do exist. However, many such folding tables only have legs that fold. The tops of the tables remain rigid. As a result, although the tables are lightweight, they are very bulky and cumbersome to carry.

A few prior art folding table designs do exist that are both lightweight for transport and have a folding tabletop. Of these prior art folding tables, most have tabletops that fold directly in half. Such prior art folding tables are exemplified by U.S. Pat. No. 3,074,770 to Sqob, entitled Camping Table.

Tables with tabletops that fold in half typically are manufactured with a handle at one end of the tabletop. As such, the folded tabletop dangles under the handle when the handle is held in a person's hand. Where this provides a means to carry the folding table, it is very difficult to carry such tables by holding the handle with an extended arm. If carried in such a manner, the half-folded table could easily contact the ground as it is being carried. This is especially true if the person carrying the folded table has a small stature. Consequently, the handles provided on such prior art tables are usually used only to lift and manipulate such tables. The handles serve little purpose in transporting the tables while walking. The folded table remains bulky and cumbersome to carry.

A need therefore exists for a table that is very lightweight and has both a tabletop and table legs that collapse into configurations that are far less than half their normal size. In this manner, the table can become small enough to comfortably transport by simply lifting and carrying the collapsed table with one hand. This need is met by the present invention as described and claimed below.

SUMMARY OF THE INVENTION

The present invention is a folding table assembly. The folding table has both a tabletop and legs that fold into smaller sizes. The tabletop has a main panel, a first side flap panel, and a second side flap panel. The first side flap panel and the second side flap panel are joined to the main panel with hinge connections. The hinge connections enable the first side flap panel and the second side flap panel to rotate from open positions that are coplanar with the main panel to folded positions that are under the main panel.

A plurality of folding legs are provided. The folding legs are coupled to the first side flap panel and the second side flap panel of the tabletop. The folding legs can move between extended positions, where the legs support the tabletop, and retracted positions, where the legs are folded flush against the first side flap panel and said second side flap panel. In this manner, the two side flap panels of the tabletop can fold under the main panel of the tabletop. The legs can fold flush against the side flap panels so that the legs are interposed between the main panel and the two side panels. This enables the table to fold into a very compact size that is easy to carry.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention folding table can be configured in many ways, only one exemplary embodiment of the folding table is illustrated. The embodiment selected sets forth the best mode contemplated for the invention. The illustrated embodiment, however, is merely exemplary and should not be considered a limitation when interpreting the scope of the appended claims.

Figure 1:
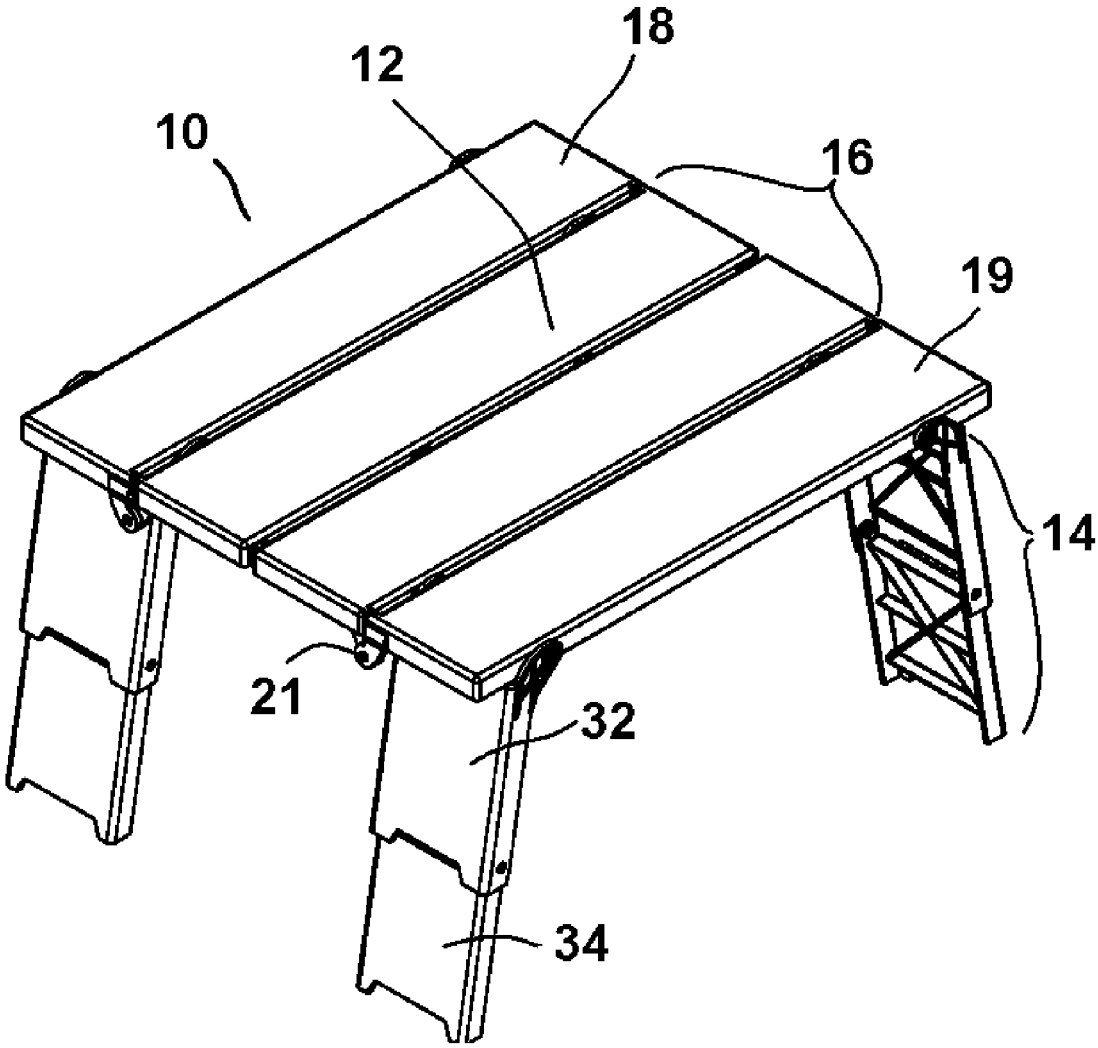
FIG. 1 is a perspective view of an exemplary embodiment of a collapsible table assembly in its open configuration.
Figure 2:
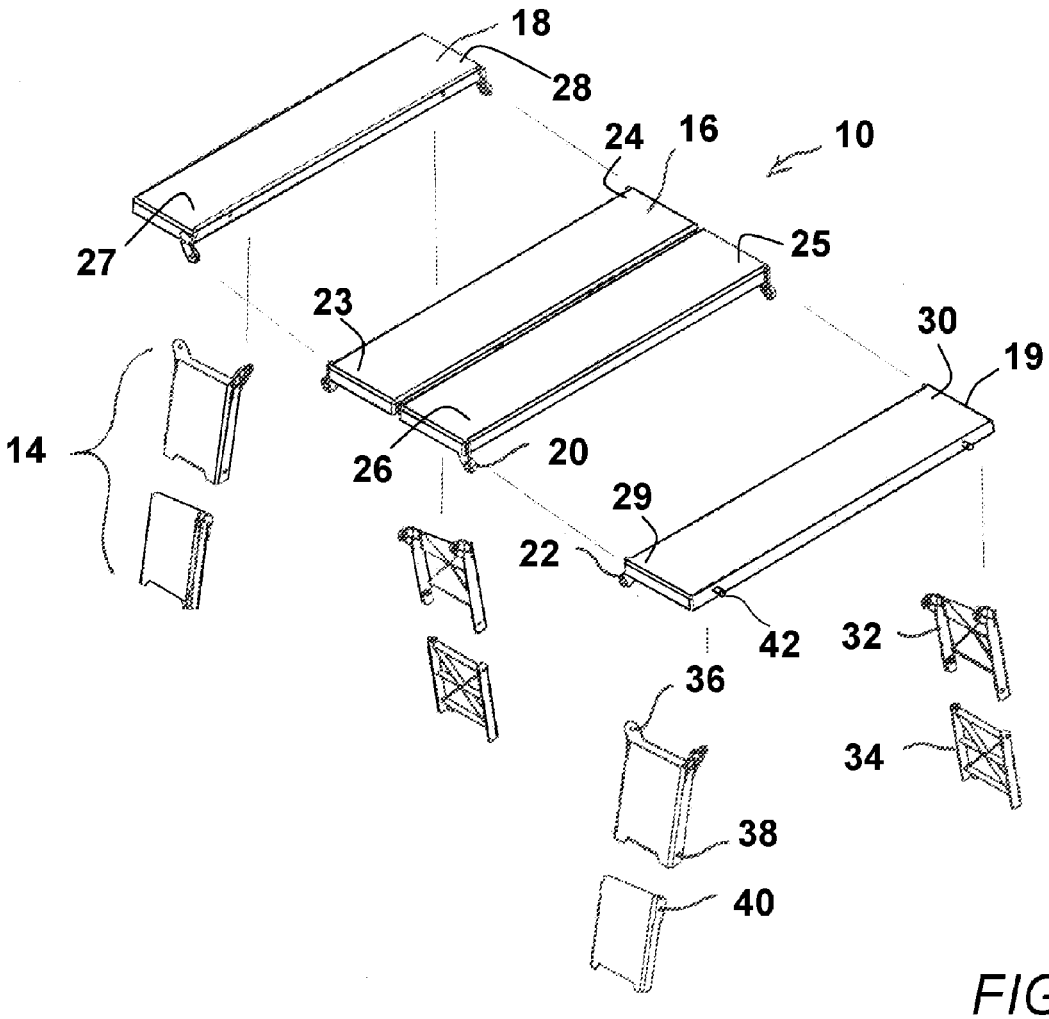
FIG. 2 is an exploded view of the embodiment of FIG. 1.

Referring to FIG. 1 in conjunction with FIG. 2, a table assembly 10 is shown. The table assembly 10 has a tabletop 12 and four leg assemblies 14. The tabletop 12 and the leg assemblies 14 are preferably all molded from plastic, so as to be lightweight. As will be explained, both the tabletop 12 and each of the four leg assemblies 14 fold into smaller configurations. This enables the overall table assembly 10 to fold into a much smaller size that is both lightweight and easy to carry.

FIG. 1 shows the table assembly 10 in its fully open configuration. When in this fully open configuration, the tabletop 12 is supported in the horizontal plane by each of the four leg assemblies 14. The tabletop 12 is not solid. Rather, the tabletop 12 is comprised of multiple interconnected panels. The interconnected panels include a wide main panel 16 and two narrower side flap panels 18, 19.

The two side flap panels 18, 19 interconnect with the main panel 16 using hinges 21. The hinges 21 enable the two side flap panels 18, 19 to rotate from an open position, where the side flap panels 18, 19 are coplanar with the wide main panel 16, to a closed position, where the side flap panels 18, 19 lay under the wide main panel 16. Each of the hinges 21 are made from two hinge projections 20, 22 that mechanically interconnect.

The wide main panel 16 has four corners 23, 24, 25, 26. Hinge projections 20 extend from the wide main panel 16 in each of the four corners 23, 24, 25, 26. The first side flap panel 18 has two inside corners 27, 28 that face the wide main panel 16. Likewise, the second side flap panel 19 has two inside corners 29, 30 that face the wide main panel 16. Hinge projections 22 extend from the side flap panels 18, 19 at the inwardly facing corners 27, 28, 29, 30. The main panel 16 and both the side flap panels 18, 19 are integrally molded with their plastic hinge protrusions 20, 22. The hinge protrusions 22 on the side flap panels 18, 19 mechanically interconnect with the hinge protrusions 20 on the wide main panel 16. This enables the side flap panels 18, 19 to fold between their open positions and folded positions.

As has been previously stated, when the side flap panels 18, 19 are in their open positions, the side flap panels 18, 19 are in the same plane as the main panel 16. The side flap panels 18, 19 and the main panel 16, therefore, present a single flat tabletop 12. The tabletop 12 can have any dimensions by varying the lengths and widths of the wide main panels 16 and the two side flap panels 18, 19. However, it is important that the length of the side flap panels 18, 19 be the same as the length of the wide main panel 16. Furthermore, it is important that the width of each of the side flap panels 18, 19 be equal to, or less than, half the width of the wide main panel 16.

The tabletop 12, when open, is supported by four separate leg assemblies 14. Each of the four leg assemblies 14 is comprised of two plastic parts. Those parts include an upper leg element 32 and a lower leg element 34. Both the upper leg element 32 and the lower leg element 34 are molded of plastic as separate parts. The upper leg element 32 and the lower leg element 34 are later joined to form a complete leg assembly 14. Each upper leg element 32 is molded with upper hinge projections 36 and lower hinge projections 38. The upper hinge projections 36 extend upwardly from the top corners of the upper leg element 32. Conversely, the lower hinge projections 38 extend downwardly from the lower corners of the upper leg element 32.

The lower leg element 34 has hinge pins 40 that extend laterally from the sides of the lower leg element 34 proximate its upper corners. The hinge pins 40 mechanically interconnect with the lower hinge projections 38 of the upper leg element 32. The result is a hinge connection between the upper leg element 32 and the lower leg element 34 that enables the lower leg element 34 to fold flush against the inside of the upper leg element 32. Furthermore, the hinge connection also enables the lower leg element 34 to linearly align with the upper leg element 32 to form a straight leg assembly 14.

Hinge pins 42 also extend from the long side edges of the side flap panels 18, 19. The upper hinge projections 36 of the upper leg elements 32 mechanically interconnect with the hinge pins 42. This forms a hinge connection between the side flap panels 18, 19 and the upper leg elements 32 of the leg assemblies 14.

Figure 3:
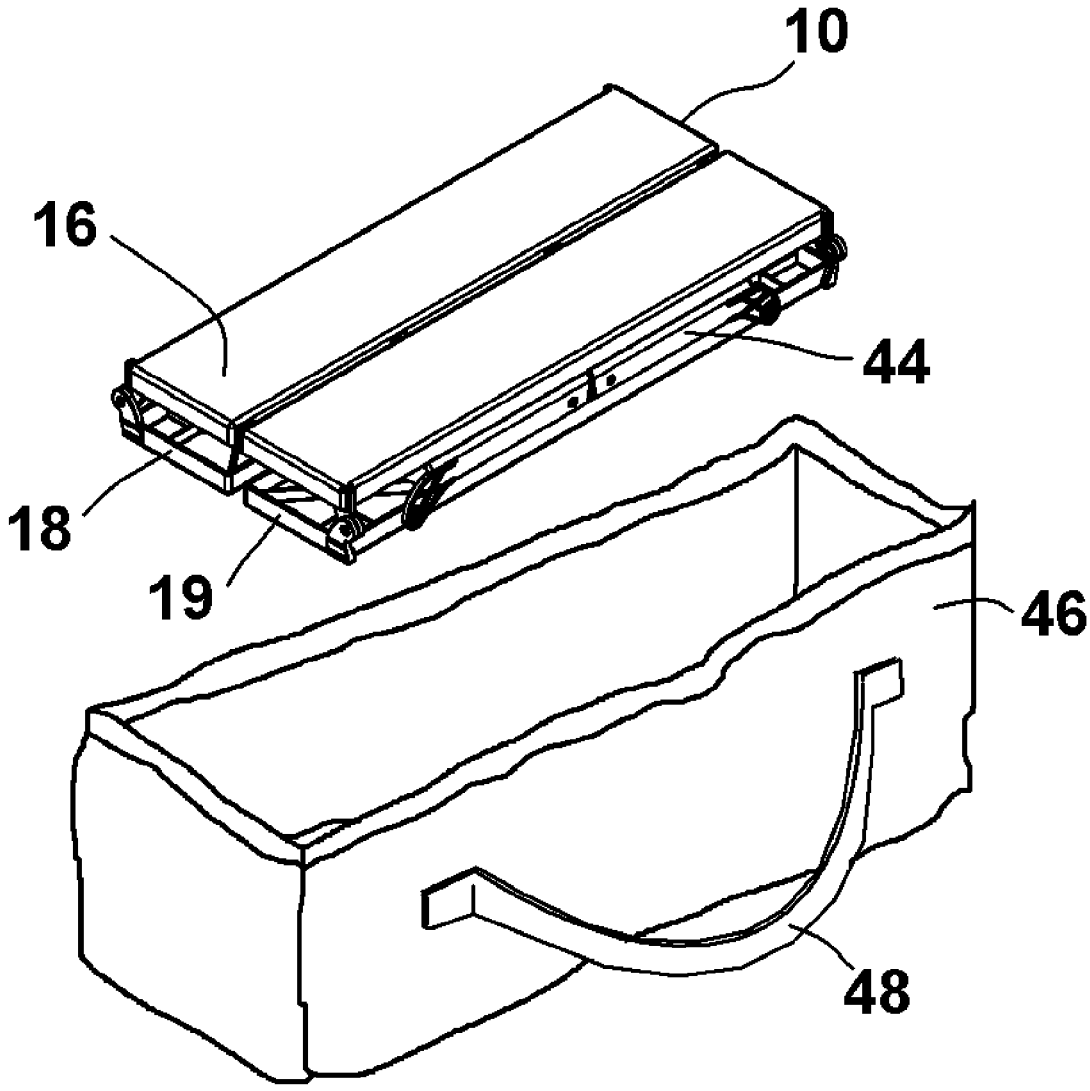
FIG. 3 is a perspective view of the collapsible table assembly shown in its closed configuration.

Referring now to FIG. 3 in conjunction with FIG. 1 and FIG. 2, it will be understood that the lower leg element 34 of each leg assembly 14 can fold up against the upper leg element 32 within the same leg assembly 14. The lower leg element 34 is smaller than the upper leg element 32 and is sized to pass into the upper leg element 32 with a spoon fit. The two leg elements 32, 34 can therefore form a very compact folded assemblage 44. The folded assemblages 44 of the two leg elements 32, 34 are then folded flush against the underside of the side flap panels 18, 19. The side flap panels 18, 19 of the tabletop 12 are folded under the main panel 16 of the tabletop 12. In this configuration, the folded assemblages 44 of the leg assemblies 14 are interposed between the main panel 16 and the two side flap panels 18, 19. The result is a densely folded table assembly 10 that is easy to carry.

A carry bag 46 is provided that is sized to receive the folded table assembly 10. The carry bag 34 has handle straps 48 that make the carrying of the table assembly 10 for long distances a comfortable endeavor. Since the entire table assembly 10 is made of molded plastic, the table assembly 10 is very lightweight. Furthermore, the table assembly 10 is capable of being repeatedly wet with ocean water or other moisture without concern of having metal parts corrode.

It will be understood that the embodiment of the present invention being illustrated is merely exemplary and that a person skilled in the art can make many variations to that embodiment. For example the length, width and height of the table assembly can be varied as desired. All such variations and alternate embodiments are intended to be included within the scope of the present invention.

What is claimed is:

1. A folding table assembly, comprising:

a tabletop having a main panel;

a first side flap panel having two long side edges, wherein hinge pins protrude from said long side edges;

wherein said first side flap panel is connected to said main panel with a first hinged connection that enables said first side flap panel to move about said first hinged connection between an open configuration, where said first side flap panel is coplanar with said main panel, and a folded configuration, where said first side flap panel is turned below said main panel;

a first leg assembly having hinge projections extending upwardly therefrom, said hinge projections engaging said hinge pins that protrude from said long side edges of said first side flap panel, therein coupling said first side flap panel to said first leg assembly with a second hinged connection, wherein said second hinged connection enables said first leg assembly to be selectively folded flush against said first side flap panel and be interposed between said first side flap panel and said main panel when said first side flap panel is in said folded configuration, and a second leg assembly coupled to said first side flap panel with a third hinged connection, wherein said third hinged connection enables said second leg assembly to be selectively folded flush against said first side flap panel and be interposed between said first side flap panel and said main panel when said first side flap panel is in said folded configuration.

2. The folding table assembly according to claim 1, further including a second side flap panel connected to said main panel with a fourth hinged connection, wherein said fourth hinge connection enables said second side flap panel to move about said fourth hinged connection between an open configuration, wherein said second side flap panel is coplanar with said main panel, and a folded configuration, wherein said second side flap panel is turned below said main panel.

3. The folding table assembly according to claim 2, wherein said first side flap panel and said second side flap panel extend from opposite sides of said main panel.

4. The folding table assembly according to claim 3, wherein said main panel has a predetermined length and both said first side flap panel and said second side flap panel have a length equal to said predetermined length.

5. The folding table assembly according to claim 4, wherein said main panel has a predetermined width and both said first side flap panel and said second side flap panel have a width that is no greater than half of said predetermined width.

6. The folding table assembly according to claim 1, wherein said first leg assembly is comprised of an upper leg element and a lower leg element that are joined along a hinged joint, wherein said hinged joint enables said lower leg element to move between an extended configuration, where said lower leg element is linearly aligned with said upper leg element, and a folded configuration, where said lower leg element is fold flush against said upper leg element.

7. A folding table assembly, comprising:

a tabletop having a main panel;

a first side flap panel having a first set of long side edges and a first set of hinge pins that protrude outwardly from said first set of long side edges;

a second side flap panel having a second set of long side edges and a second set of hinge pins that protrude outwardly from said second set of long side edges, wherein said first side flap panel and said second side flap panel are joined to said main panel with hinged connections that enable said first side flap panel and said second side flap panel to rotate from open positions that are coplanar with said main panel to folded positions under said main panel;

a first folding leg comprised of an upper leg element and a lower leg element that are joined along a hinged joint, wherein said hinged joint enables said lower leg element to move between an extended configuration, where said lower leg element is linearly aligned with said upper leg element, and a folded configuration, where said lower leg element is folded flush against said upper leg element, said first folding leg having a first set of hinge projections extending upwardly therefrom, said first set of hinge projections engaging said first set of hinge pins that protrude from said first set of long side edges, therein coupling said first folding leg to said first side flap panel, wherein said first folding leg can move between an extended position, where said first folding leg supports said tabletop, and a retracted position where said first folding leg is folded flush against said first side flap panel; and a second folding leg having a second set of hinge projections extending upwardly therefrom, said second set of hinge projections engaging said second set of hinge pins that protrude from said second set of long side edges, therein coupling said second folding leg to said second side flap panel, wherein said second folding leg can move between an extended position, where said second folding leg supports said tabletop, and a retracted position where said second first folding leg is folded flush against said second side flap panel.

8. The folding table assembly according to claim 7, wherein said folding table assembly is selectively configurable between an open condition and a folded condition, wherein when in said open condition, said first folding leg and said second folding leg support said first side flap panel and said second side flap panel in a common plane with said main panel, and wherein when in said folded condition, said first folding leg and said second folding leg are interposed between said main panel and both said first side flap panel and said second side flap panel.

9. The folding table assembly according to claim 7, wherein said main panel has a predetermined length and both said first side flap panel and said second side flap panel have a length equal to said predetermined length.

10. The folding table assembly according to claim 9, wherein said main panel has a predetermined width and both said first side flap panel and said second side flap panel have a width that is no greater than half of said predetermined width.

11. A folding table assembly, comprising:

a tabletop having a main panel;

a first side flap panel having two long side edges, wherein hinge pins protrude from said long side edges;

wherein said first side flap panel is connected to said main panel with a first hinged connection that enables said first side flap panel to move about said first hinged connection between an open configuration, where said first side flap panel is coplanar with said main panel, and a folded configuration, where said first side flap panel is turned below said main panel;

a first leg assembly having hinge projections extending upwardly therefrom, said hinge projections engaging said hinge pins that protrude from said long side edges of said first side flap panel, therein coupling said first side flap panel to said first leg assembly with a second hinged connection, wherein said second hinged connection enables said first leg assembly to be selectively folded flush against said first side flap panel and be interposed between said first side flap panel and said main panel when said first side flap panel is in said folded configuration, wherein said first leg assembly is comprised of an upper leg element and a lower leg element that are joined along a hinged joint, wherein said hinged joint enables said lower leg element to move between an extended configuration, where said lower leg element is linearly aligned with said upper leg element, and a retracted configuration, where said lower leg element is fold flush against said upper leg element.

* * * * *